United States Patent [19]

Famolare, Jr.

[11] 3,936,956

[45] Feb. 10, 1976

[54] REFLEX ACTION SOLE FOR SHOES HAVING SINUOUS CONTOURED BOTTOM SURFACE

[75] Inventor: Joseph P. Famolare, Jr., Florence, Italy

[73] Assignee: Famolare, Inc., New York, N.Y.

[22] Filed: Aug. 22, 1974

[21] Appl. No.: 499,493

[52] U.S. Cl. ..... 36/32 R

[51] Int. Cl.[2] ..... A43B 13/04

[58] Field of Search ..... 36/32, 33, 2.5 R, 28

[56] References Cited

UNITED STATES PATENTS

| | | | |
|---|---|---|---|
| 1,486,630 | 3/1924 | Burnett | 36/33 X |
| 2,307,402 | 1/1943 | Gregg | 36/32 R X |
| 2,557,946 | 6/1951 | Crooker | 36/32 R |
| 2,725,645 | 12/1955 | Scala | 36/32 R X |
| 3,566,487 | 3/1971 | Beightol | 36/2.5 R |
| 3,719,965 | 3/1973 | Chevallereau | 36/32 R X |
| 3,835,556 | 9/1974 | Panaretos | 36/33 R |

FOREIGN PATENTS OR APPLICATIONS

| | | | |
|---|---|---|---|
| 2,020,578 | 11/1971 | Germany | 36/32 R |
| 81,434 | 11/1919 | Switzerland | 36/28 |

*Primary Examiner*—Alfred R. Guest

*Attorney, Agent, or Firm*—Mandeville and Schweitzer

[57] ABSTRACT

A contoured sole for providing wearers with a reflex thrust action in response to walking movements is disclosed herein. The reflex thrust is achieved by incorporating therebetween, a special undulating construction, having multiple crests with troughs in the bottom of the sole. Accordingly, the new sole is provided with a series of specifically defined and segregated portions, which cooperate to enhance and control in a positive and beneficial manner, the walking movements and comfort of the wearer.

19 Claims, 7 Drawing Figures

REFLEX ACTION SOLE FOR SHOES HAVING SINUOUS CONTOURED BOTTOM SURFACE

STATEMENT OF THE INVENTION

In general terms, this invention relates to a specifically designed resilient sole for shoes, to provide certain benefits for the wearer not otherwise available from conventional soles. More particularly, this invention relates to a generally wedge-shaped, substantially thickened sole having undulating or sinuous contours along the bottom surface thereof. This sole, with its sinuous or "wave-like" contour, serves to form multiple contact zones which enhance the movements of the wearer by adding to or supplementing normal walking movements in reflex and rolling actions, thereby increasing the thrust and roll of the foot, leg and spine movements for each stride during the walking action. Moreover, the contours of the sole, in accordance herewith, serve to improve posture and leg muscle tone during standing because of the inherent rocking action given to the wearer of shoes incorporating the sole herein.

BACKGROUND OF THE INVENTION

The prior art discloses a variety of shoe soles contoured for a plethora of purposes. For example, wedge-shaped inclined soles have been developed for use in playing golf and other sports-related activities, to facilitate the assumption of appropriate stances during a golf swing or other physical activity. In addition, contoured "orthopedic soles" have been developed for enhancing the comfort and physical well-being of the wearer. These developments, to varying degrees, contribute to the comfort or the proper stance of the wearer, or force the wearer during stride to maintain his foot in a certain orientation when the sole is placed on a supporting surface.

SUMMARY OF THE INVENTION

With this invention, by contrast, a new and improved contoured sole is provided which enhances in a positive manner, by a reflex action, the striding movements of the wearer. A generally wedge-shpaed sole is provided for shoes, with a bottom surface configured to enhance and to generate the body movements of the wearer from the moment the heel is placed on the ground or other supporting surface to the time the toe leaves the ground in a striding action. Moreover, the sole of this invention, because of the compound curved bottom surfaces thereof, provides a rocking and thrusting action even during standing, which rocking action serves to enhance and tone the leg muscles of the wearer. This results in an exhilarating, determined stride, which reduces fatigue and ultimately enhances the desire and ability to walk, and gives the wearer a feeling of well-being.

Specifically, the bottom surface of the sole defines a series of alternating ground-contacting crests and troughs, which give the sole a free-flowing, wave-like appearance. The rearmost crest in the heel portion of the sole gives the wearer a roll-like head start (there is a longer contact period in comparison with a squared, non-rounded heel) in his stride during the initial impact with the ground or other supporting surface. Moreover, it absorbs impact shock. The second crest imparts a slight thrust to the wearer in the arch region of the foot during the rolling placement of the arcuate sole surfaces on the ground, serves to generate a further forward propulsion force during the stride, and also absorbs impact shock.

The third crest at the ball of the foot impacts with the ground at the peak of the stride, and enhances the generation of forward momentum. The fourth and final crest at the toe of the shoe is elevated above the general surface plane of the other crests and provides a rolling finish for the stride, and develops a positive, determined forward thrust for the commencement of the next step in the walking action.

In conjunction with the curved contour of the bottom sole surface, in accordance herewith, the upper or insole surface thereof is "orthopedically" contoured to properly support the foot in overall contact. Accordingly, the toe portion of the insole is raised with a lower, gradual curved area in the ball area of the foot, and with a gradually curved and raised platform area for the arch and heel of the foot.

Before describing this invention further, it should be noted that the sole herein is of generally solid construction. However, if desired or necessary, the sole may be lightened and strengthened by an internal honeycomb structure. It may be manufactured by molding from natural or synthetic elastomers, various resins, including thermoplastics, and a variety of foamed resin materials. Preferably, the material will be somewhat flexible to enhance the thrusting action of the sole. The sole may be combined with a conventional upper of a flexible material, including leathers, or synthetic materials, canvas and other fabrics, etc., to form a unique and improved walking shoe. Moreover, the upper may be of a scuff-like design with an open heel, or it may be straps, providing a sandal-like configuration.

With the foregoing and additional objects in view, this invention will now be described in more detail, and other objects and advantages hereof will be apparent from the following description, the accompanying drawings, and the appended claims.

As purely illustrative of an arrangement of the positive reflex action sole of this invention, the accompanying drawings illustrate a "wedge"-type sole, with a conventional scuff-type upper comprised of a relatively soft, flexible material such as leather, synthetic leather, canvas or other fabric.

DESCRIPTION OF THE PREFERRED EMBODIMENT

Figure 1:
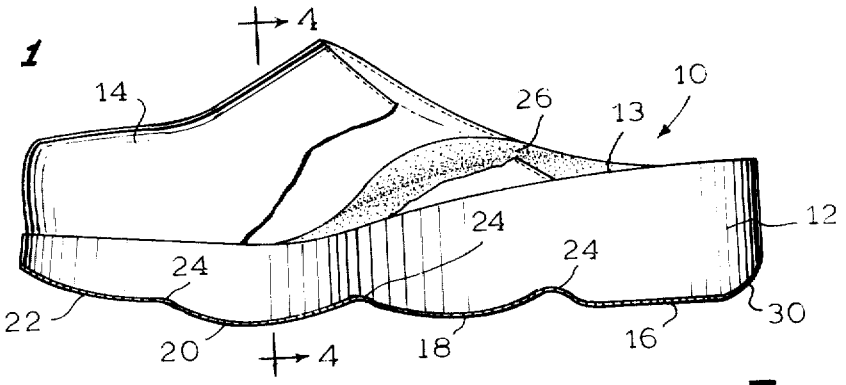
FIG. 1 is a side elevational view of a scuff-type shoe with the sole of the invention, and with the upper partially broken away to show the contour of the upper surface of the sole.
Figure 4:
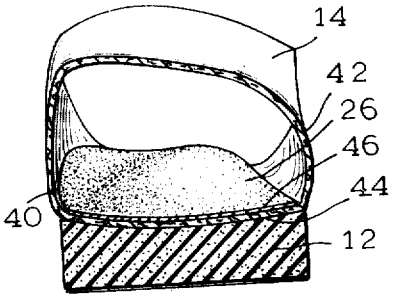
FIG. 4 is a cross-sectional view taken along line 4—4 of FIG. 1.
Figure 5:
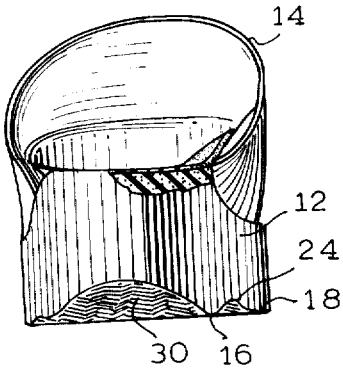
FIG. 5 is a rear elevational view of the shoe of FIG. 1.
Figure 6:
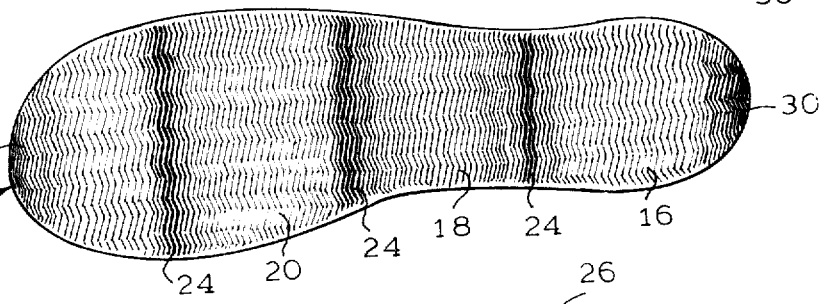
FIG. 6 is a plan view of the bottom surface of the sole of FIG. 1.
Figure 7:
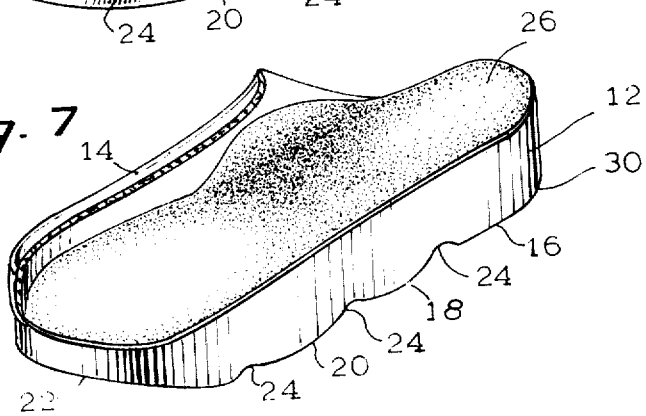
FIG. 7 is a perspective view of the shoe of FIG. 1, with a portion of the upper broken away.

Referring to the drawings, in which like reference characters refer to like parts throughout the several views thereof, FIG. 1 shows a scuff-type shoe generally designated as 10, incorporating the sole 12 of the invention, with a relatively soft, flexible upper 14. As shown, the upper has an open back design, although it will be apparent that a conventional closed back upper may be used with the sole 12 of the invention. Moreover, the upper may be of a relatively rigid material, if desired. The upper 14 may be adhered or otherwise conventionally fastened by mechanical means to the sole 12 in a wrap-around fashion, as shown in FIG. 4, with one side 40 of upper 14 folded under, as shown at 44, and adhered by conventional adhesives to sole 12. The opposite side 42 of upper 14 may then be folded as shown at 46, and adhered to that portion 44 of the upper already adhered to the sole 12. Subsequently, if desired, a separate insole 26 may be inserted and adhered to layer 46 of upper 14, again by conventional adhesives. Of course, it should be understood that these various layers may be sewn together, stapled, nailed, or heat sealed, if desired, or if more appropriate for the type of materials utilized.

As shown in FIG. 1, the bottom surface of the sole 12 is divided into a series of curved crest portions 16, 18, 20 and 22, with each of these portions separated by a trough 24. This alternating pattern of crests and troughs serves to incorporate into sole 12 an inherent roll-generating action, which provides for the wearer a positive enhanced reflex action during his striding movements.

Figure 3:
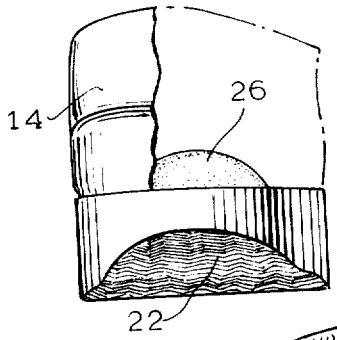
FIG. 3 is a front elevational view of the shoe of FIG. 1, again with a portion of the upper broken away.

During the initial step of the foot on a supporting surface, such as the ground, the raised curved portion 30 of the heel curve 16, which is substantially rigid because of the thickened section thereof, initiates a determined rolling action to the beginning of the stride. Subsequently, upon impact of the curved portion 18 at the arch region, there is a second impact and subsequent rolling action, not provided in a conventional sole, which provides an impetus to the wearer, positively projecting the sole forward in a rolling, striding action. Subsequently, upon impact of crest 20, there is an automatic, positive reflex forward motion given to the wearer, which thrusts him forward in the continuing movement of the gait or stride. Finally, upon impact of crest 22, there is a rolling finish and a compound flexion of the sole about the axis of the forwardmost trough 24, rather than the usual abrupt finish prior to removing the foot from the supporting surface. In this connection, it should be noted that the toe portion 22 of the bottom surface of sole 12 is elevated with respect to the remaining bottom surfaces (FIG. 3) to enhance this forward rolling action.

Although, as discussed above, the sole may be comprised of a variety of materials, it is preferred, in accordance herewith, that the sole will be comprised of a flexible and resilient material, advantageously as a natural or synthetic elastomer such as "Kraton" (styrene-butadiene block copolymer, by Shell Oil Company) to impart flexibility and resiliency to sole 12 and to enhance its positive reflex action during the striding movements of the wearer.

Figure 2:
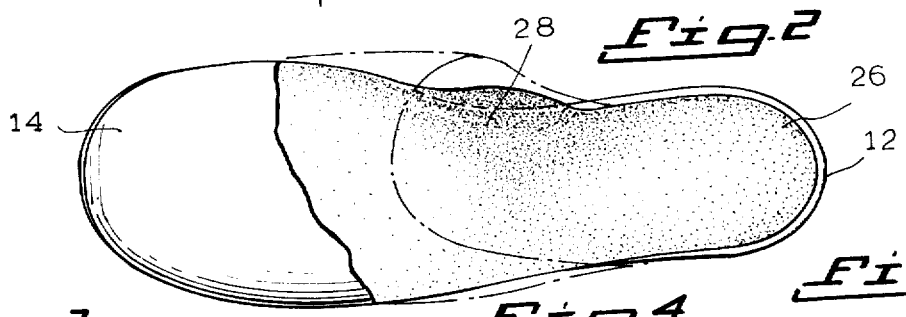
FIG. 2 is a top plan view of the shoe of FIG. 1.

Moreover, sole 12 is provided with a curved contoured top surface 13, as shown in FIG. 1, in order to configure the bottom of the foot of the wearer to the sequential consecutive curved impacts during the striding action. Moreover, as shown in FIG. 2, the inner side 28 may be slightly raised to accommodate and conform the top surface 13 of sole 12 to the arch of the wearer.

It should be noted further that, in moments of standing, the continuously curved contour of the bottom surface of the sole, in accordance herewith, initiates a positive rocking action, which serves to stretch the front and back muscles of the leg and improves the muscle tone thereof.

Thus, as will be apparent from the foregoing, there is provided, in accordance herewith, a sole for shoes which enhances and controls the walking movements of the wearer by positively superimposing a continuous series of reflex actions to the movements of the wearer. The wearer is, therefore, inspired to move with a determined gait, the individual strides of which tend to be increased due to the forwardmost and rearwardmost curves or crests. Moreover, the construction of the sole herein, with its curved configuration, incorporates a continuous impulse-type reflexive action which increases the muscle tone of the wearer, whether or not he is walking or merely standing still. There is, ultimately, therefore, a feeling of well being and a substantial reduction in fatigue in the use of shoes incorporating the soles, in accordance herewith. Moreover, because of the relative simplicity of the configuration of the sole herein, it may be comprised of a variety of different moldable, resilient and flexible materials, which may be easily and economically formed into the desired configuration by mass production molding techniques. The sole, as discussed above, may be combined with a wide variety of different uppers to form many different styles of shoes, all of which provide the beneficial characteristics of the illustrated shoe.

While the particular arrangement of sole described herein is one embodiment of this invention, this invention is not limited to that particular arrangement, and, as will be appreciated and understood by those skilled in the art, changes may be made therein without departing from the scope of the invention which is defined in the appended claims. For example, the specific geometry of the sole may be modified or somewhat altered (in terms of proportions, number of crests and troughs, etc.) while maintaining the beneficial properties and characteristics of the illustrated sole by stretching the back of the leg and providing a distinct and positive forward thrust to the wearer in a general, "free flowing," multiple waved manner.

I claim:

1. A reflex action one-piece sole for shoes, which comprises a. a longitudinally extending thick body of resilient, shnock absorbing material;

b. said body including generally horizontal upper surfaces, an edge wall having front, side, and rear portions, and a bottom surface;

c. said bottom surface comprised of alternating crests and troughs extending completely thereacross and being generally perpendicular to the longitudinal axis of said body;

d. said crests including spaced, lowermost ground contacting portions;

e. said alternating crests constituting in succession, a forwardmost toe crest, an intermediate ball crest, an intermediate shank portion crest, and a heel crest, the lowermost ground contacting surfaces of the latter three crests lying in a substantially common plane;

f. said forwardmost toe crest being elevated with respect to the remainder of said crests and extending forwardly toward and terminating at front edge portions of said sole to provide a rolling, thrusting action as the sole is progressively engaged with a ground surface in walking; and g. said heel crest extending upwardly and rearwardly toward and terminating in said rear edge portions of said sole to provide an initial rolling action as the sole is progressively engaged with a ground surface in walking;

h. said sole thereby providing a gentle rocking motion as it progressively contacts a ground surface.

2. A reflex action one-piece sole for shoes in accordance with claim 1, in which a. said upper foot supporting surfaces are contoured to conform to the anatomical lower surfaces of a human foot.

3. A reflex action one-piece sole for shoes in accordance with claim 1, in which a. said resilient shock absorbing material is a styrene-butadiene block copolymer-like elastomer.

4. A reflex action one-piece sole for shoes in accordance with claim 1, in which a. said body is generally wedge-shaped, the rearwardmost upper foot supporting surfaces being disposed in a higher plane than the forwardmost foot supporting surfaces.

5. A reflex action one-piece sole for shoes in accordance with claim 1, in which a. said heel crest has a generally flat central portion.

6. A reflex action one-piece sole for shoes in accordance with claim 1, in which a. said intermediate ball crest, said intermediate shank portion crest, and said heel crest are substantially equal in length.

7. A reflex action one-piece sole for shoes, which comprises a. a longitudinally extending thick body of resilient, shock absorbing material;

b. said body including an upper foot supporting surface, an edge wall having front, side, and rear portions, and a bottom surface;

c. said bottom surface comprised of alternating crests and troughs extending completely thereacross and being generally perpendicular to the longitudinal axis of said body;

d. said crests including spaced, lowermost ground contacting portions;

e. said alternating crests constituting in succession, a forwardmost toe crest, an intermediate ball crest, an intermediate shank portion crest, and a heel crest.

8. The reflex action one-piece sole of claim 7, in which a. the lowermost ground contacting surfaces of the latter three crests lying in a substantially common plane;

b. said forwardmost toe crest being elevated with respect to the remainder of said crests and extending forwardly toward and merging into front edge portions of said sole.

9. The reflex action one-piece sole of claim 8, in which a. said heel crest extending upwardly and rearwardly toward and merging into said rear edge portions of said sole.

10. The reflex action one-piece sole of claim 7, in which a. said upper foot supporting surfaces are contoured to conform to the anatomical lower surfaces of a human foot.

11. The reflex action one-piece sole of claim 7, in which a. said resilient shock absorbing material is a styrene-butadiene block copolymer-like elastomer.

12. The reflex action one-piece sole of claim 7, in which a. said body is generally wedge-shaped, the rearwardmost upper foot supporting surfaces being disposed in a higher plane than the forwardmost foot supporting surfaces.

13. The reflex action one-piece sole of claim 7, in which a. said heel crest has a generally flat central portion.

14. A reflex action one-piece sole for shoes, which comprises a. a longitudinally extending thick body of resilient, shock absorbing material;

b. said body including an upper foot supporting surface, an edge wall having front, side, and rear portions, and a bottom surface;

c. a plurality of shallow shaped crests having predetermined circumferential lengths and predetermined depths, said circumferential lengths being a multiple of not less than six times said predetermined depths for each of said shallow shaped crests;

d. said crests including spaced, lowermost ground contacting portions; and e. said alternating crests constituting in succession, a forwardmost toe crest, at least one intermediate crest, and a heel crest.

15. The reflex action one-piece sole of claim 14, in which a. said resilient shock absorbing material is a styrene-butadiene block copolymer-like elastomer.

16. The reflex action one-piece sole of claim 14, in which a. said body is generally wedge-shaped, the rearwardmost upper foot supporting surfaces being disposed in a higher plane than the forwardmost foot supporting surfaces.

17. The reflex action one-piece sole of claim 14, in which a. said heel crest has generally flat central portions.

18. The reflex action one-piece sole of claim 14, which further includes a. a foot retaining upper means affixed to said one-piece sole along peripheral portions thereof.

19. The reflex action one-piece sole of claim 18, in which a. said upper foot supporting surfaces are contoured to conform to the anatomical lower surfaces of a human foot.

* * * * *

Disclaimer 3,936,956.—*Joseph P. Famolare, Jr.*, Florence, Italy. REFLEX ACTION SOLE FOR SHOES HAVING SINUOUS CONTOURED BOTTOM SURFACE. Patent dated Feb. 10, 1976. Disclaimer filed May 14, 1976, by the assignee, *Famolare, Inc.*

The term of this patent subsequent to July 8, 1989, has been disclaimed.

[*Official Gazette July 6, 1976.*]

UNITED STATES PATENT AND TRADEMARK OFFICE

CERTIFICATE OF CORRECTION

PATENT NO. : 3,936,956

DATED : February 10, 1976

INVENTOR(S) : JOSEPH P. FAMOLARE, JR.

It is certified that error appears in the above-identified patent and that said Letters Patent are hereby corrected as shown below:

Column 4, line 47, change "shnock" to --shock--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*